United States Patent [19]

Veith et al.

[11] 4,112,332

[45] Sep. 5, 1978

[54] MATRIX-ADDRESSED GAS-DISCHARGE DISPLAY DEVICE FOR MULTI-COLORED DATA DISPLAY

[75] Inventors: Werner Veith, Munich; Martin Bechteler, Unterfoehring, both of Germany

[73] Assignee: Siemens Aktiengesellschaft, Berlin & Munich, Germany

[21] Appl. No.: 783,570

[22] Filed: Apr. 1, 1977

[30] Foreign Application Priority Data

Apr. 9, 1976 [DE] Fed. Rep. of Germany ..... 2615569

[51] Int. Cl.[2] ..... H05B 37/00; H05B 39/00; H05B 41/00

[52] U.S. Cl. ..... 315/169 TV; 340/324 M

[58] Field of Search ..... 315/169 TV, 337, 350; 340/324 M; 313/195; 358/240, 241

[56] References Cited

U.S. PATENT DOCUMENTS

| | | | |
|---|---|---|---|
| 3,873,870 | 3/1975 | Fukushima et al. | 313/217 |
| 3,956,667 | 5/1976 | Veith | 315/169 TV |

*Primary Examiner*—Alfred E. Smith
*Assistant Examiner*—Robert E. Wise
*Attorney, Agent, or Firm*—Hill, Gross, Simpson, Van Santen, Steadman, Chiara & Simpson

[57] ABSTRACT

A gas-discharge display device for multi-colored data display in three basic colors, comprising a gas-filled, gas-tight enclosure, a board-like matrix control structure, dividing the enclosure into two chambers, which is in the form of an insulating plate having a plurality of apertures therethrough, arranged in an array of coordinate lines corresponding in number to a desired number of image points. A plasma electrode is disposed in one chamber and a luminescent screen electrode disposed in the other chamber. The control structure includes a plurality of anode conductors disposed on the side of said plate facing said plasma electrode, and a plurality of control conductors disposed on the side of said plate facing said luminescent screen electrode, with each of the conductors extending around the edges of the associated apertures. The plasma electrode is so disposed that, upon application of appropriate potentials, a gas discharge can burn in the discharge chamber, while the luminescent screen electrode is disposed sufficiently close to the adjacent conductors on the matrix member that even a few kV applied to such screen electrode cannot trigger any undesired gas discharge. The anode conductors each contain a corresponding line of apertures with each three successive apertures being allotted to the three basic colors, and each third aperture being allotted to the same basic color. Each control conductor interconnects each successive aperture along the line in which such conductor extends, and each of the latter may include apertures allotted to two of the three basic colors.

20 Claims, 8 Drawing Figures

MATRIX-ADDRESSED GAS-DISCHARGE DISPLAY DEVICE FOR MULTI-COLORED DATA DISPLAY

BACKGROUND OF THE INVENTION

The invention relates to a gas-discharge display device comprising a gas-filled, gas-tight enclosure in which an insulating matrix member, in the form of an insulating plate, divides the housing into two chambers. The insulating plate is provided with a plurality of apertures therethrough, arranged in an array of rows and columns corresponding in number to the desired number of image points. A plasma electrode is disposed in one chamber which may be in the form of a surface cathode extending parallel with the insulating matrix plate and provided with a luminescent screen electrode which is disposed in the other chamber. A plurality of anode conductors are disposed on the side of the plate facing the cathode electrode and a plurality of control conductors are disposed on the opposite side of the plate facing the screen electrode, with each of the conductors extending around the edges of the associated apertures, and each of the conductors on one side being associated with a respective row of apertures, and each of the conductors on the other side being associated with a respective column of apertures. The cathode electrode is so disposed that, upon application of appropriate potentials to the respective conductors and cathode electrode, a gas discharge can burn in the discharge chamber, and the luminescent screen electrode is disposed sufficiently close to the adjacent conductors on the matrix member that under such conditions a potential of even a few kV applied to such screen electrode cannot trigger any undesired gas discharge. Devices of this type have become known in various embodiments. For example, a device constructed in this manner and provided with a surface cathode is illustrated in U.S. Pat. No. 3,956,667.

The display illustrated and described in the above referred to patent operates on the principle of spatially separated electron generation and re-acceleration with the display structure being divided by a suitable conductor matrix, provided with aperttures at its points of intersection, which forms a rear chamber and a front chamber as viewed from an observer's position. A gas-discharge burns in the rear chamber, hereinafter termed the "discharge chamber", while the front chamber is provided with an anode extending thereacross, to which is supplied a potential of a few kV, but as the conductor matrix and the anode are disposed in a relatively very close relationship, a gas discharge cannot be involuntarily produced. In the operation of the panel, plasma electrons are drawn from the discharge chamber, through selectively actuated matrix apertures, into the front chamber hereinafter referred to as the "re-acceleration chamber", where such electrons are accelerated and finally absorbed by the anode. At the point of impact a dot of light is produced, the brilliance of which is dependent upon the magnitude of the actuating signal, which dot appears on a luminescent material placed in front of the anode. With such a two-chamber design, especially when a direct-axis plasma is produced between the surface cathode and any one matrix line (see U.S. Pat. No. 3,956,667), a particularly bright display with infinitely variable brilliance can be obtained. This has had the result of giving fresh impetus to the work, to which particular importance has been attached for some years, with respect to the development of a television picture screen based on gas-discharge.

For the most part, previous two-chamber displays of the prior art, utilizing a control matrix dividing the chamber of the enclosure, for example, U.S. Pat. Nos. 3,622,829 and 3,800,186, have involved monochrome display. However, the previously referred to U.S. Pat. No. 3,956,667 has features which may be applicable to multicolor reproduction with the aid of three basic colors. In contrast thereto, an abundance of specific proposals with respect to multicolored reproduction heretofore have been presented in connection with gas-discharge panels of conventional design, but these proposals are not applicable to display devices utilizing a control structure of the type herein involved. If it is desired to provide a colored dot configuration in correspondence to that which is provided in the conventional mask-type picture tube employing phosphor dots, it would be necessary to provide combined pairs of rows of apertures lying one below the other for one picture line and to connect apertures in the control structure lying one below the other by a column conductor, in which case, the adjacent column conductors would lie too close to one another, even if one were to employ extremely narrow conductor paths, and would create capacity levels that would impose extraordinarily heavy loads on the driving stages, as well as create crosstalk.

BRIEF SUMMARY OF THE INVENTION

The invention has among its objects the production of a display device, of the type initially described, for color display which can be manufactured without undue expense and, in particular, in which the color dots are so disposed on the display screen and the apertures in the control structure so matched to the individual color elements and the matrix conductors that, while retaining adequate optical resolving power, only a relatively small number of connections are required on the control structure. This objective is achieved in the present invention, in connection with the employment of a gas-discharge display device of the general type illustrated in said U.S. Pat. No. 3,956,667, in which the auxiliary anodes comprise respective row or line conductors and the control electrodes comprise the column conductors of the matrix.

In a panel constructed in accordance with the invention, without the usual hexagonal color-dot screen configuration, each control electrode, i.e., row conductor comprises merely a single row of apertures, whereby the distance between adjacent auxiliary anodes can be selected within relatively wide limits, with the final number of supply lines and control electrodes being materially reduced. In this construction, the resolving power of the proposed display is determined in the direction of the control electrodes by the number of auxiliary anodes employed. In the direction of such auxiliary anodes, the resolution can readily be improved by disposing the apertures of an auxiliary anode in closer relationship in view of which it would be appropriate to employ relatively narrow aperture configurations, for example ellipses, slots or rectangular configurations. Elongated apertures also have the additional advantage that they can be operatively closed and operatively fully opened with only a small increase in voltage on the control electrodes whereby, in at least some applications, all of the actuating components can be fabricated as integrated switching circuits. The effect of the aperture cross-section on the control function of such an aperture is discussed in detail in U.S. Patent application, Ser. No. 783,720.

If it is desired to further improve the physiological impression imparted by the proposed display, the color allocation for the even-numbered auxiliary anodes can be offset or shifted along the auxiliary anodes, for example, by approximately the corresponding dimension of one aperture. whereby the apertures of the even-numbered anodes are laterally offset relative to the adjacent apertures of the odd-numbered auxiliary anodes. In other words, alternate apertures of a column are laterally offset with respect to the intermediate apertures.

In this construction, all three basic colors are allocated to the apertures of each auxiliary anode, which are arranged in repetitious sequence across the anodes, while each control electrode has two colors allocated thereto which alternate along the electrode. Thus, individual electrodes, either anode or control electrodes, are not individually associated with merely a single color. Surprisingly, such an optically advantageous color arrangement does not present any new actuation problems. If the normal scanning operations employed in television picture screens (interlaced scanning) for actuating the auxiliary anodes, the odd-numbered auxiliary anodes will be initially activated during the firsthalf period and the even-numbered anodes during the following secondhalf period. During the creation of a half-image, the respective individual control electrodes involve only a single color. It is then merely necessary to insure that the control electrodes receive signals of the right color during each half-period. A typical color transposer, disposed ahead of the column actuating components, may readily be utilized for such purpose.

A particularly favorable optical quality can be achieved if the color allocation is not only shifted in the manner described, but the apertures in the even-numbered auxiliary anodes are additionally shifted in the direction of offset by an amount corresponding to about half the distance between successive apertures in an auxiliary anode.

As a result of the savings achieved, it is possible, in accordance with the invention, to make low-capacity conductor structures with comparatively extensive freedom as to configuration. Consequently the cost involved in connection with actuation of the structure likewise drops and the conductor path supply lines and connections with the actuating components are simplified. These advantages are of particular importance in connection with large-format displays with high resolving power. The number of supply lines can also be further reduced if the actuation is done in accordance with the so-called self-scan method [see Electronics 43 (1970), page 120, or Proc. IEEE 61 (1973), page 1025].

BRIEF DESCRIPTION OF THE DRAWINGS

In the drawings wherein like reference characters indicate like or corresponding parts.

Figure 1:
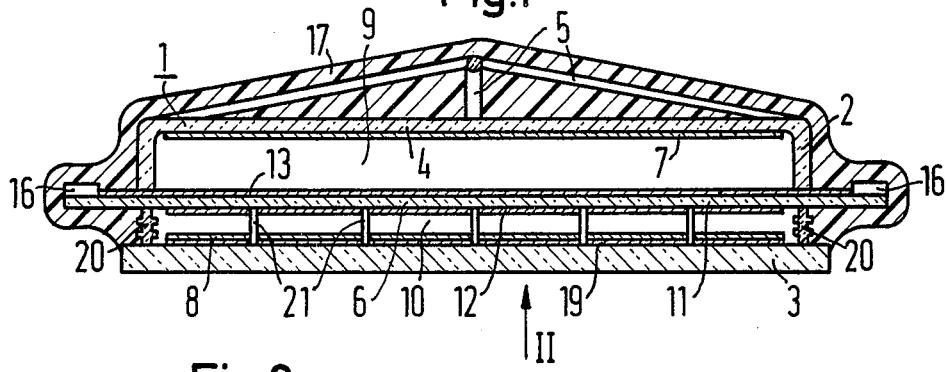
FIG. 1 is a transverse sectional view illustrating an example of a display device in accordance with the present invention.

For simplicity and improved clarity, the drawing is highly diagrammatic in portions thereof, all of the components of a gasdischarge display not absolutely necessary for an understanding of the present invention, such as electrode supply lines, individual components to the actuation circuit and the like in many instances being merely diagrammatically illustrated or omitted from the drawings.

DETAILED DESCRIPTION OF THE INVENTION

Referring to the drawings and more particularly to FIG. 1, which illustrates a display device particularly adapted for use as a television picture screen, the reference numeral 1 designates generally an enclosure having side walls 2, a front plate 3, a back plate 4 and reinforcing and strengthening struts 5, together with a control structure 6, a surface cathode 7 and a screen or acceleration anode 8. The control structure extends through the side walls 2 of the enclosure and divides the interior of the latter into a rear discharge chamber 9 and a front re-acceleration chamber 10, as seen from the observing position.

The control structure 6 comprises a thin sheet 11, for example of glass, which is provided on both its faces with a plurality of parallel conductor paths comprising column conductors 12 and row conductors 13, which are cooperable to form a matrix structure, including apertures 15 in the respective conductors 13 and corresponding apertures in the sheet 11. The individual conductor paths are only diagrammatically shown in FIG. 1, with their actual configuration, in accordance with the invention, being illustrated in FIGS. 3 and 4. The ends of the row or column conductors extend through the side walls of the enclosure and terminate adjacent the peripheral edge of the sheet exteriorly of the enclosure, making suitable contact connections with the components of the actuation circuits also located on the edge portions of the sheet. Such components are only indicated in FIG. 1 by the general reference numeral 16, with their exact location and connections to the conductor supply lines being illustrated in FIGS. 6 and 7. To provide increased mechanical strength and protection against atmospheric influences, the edge of the sheet, including the actuation components and conductor terminations, as well as the enclosure, are all imbedded in a suitable synthetic resin covering or casing 17.

The surface cathode 7 is disposed within the discharge chamber 9 of the picture screen structure and is mounted on the inner face of the rear plate 4, covering the entire matrix area. The screen anode 8 is similarly disposed within the re-acceleration chamber 10 overlying a coating of luminescent material 19 applied to the interior face of the front plate 3, and likewise extends over the entire matrix area. As the anode must be maintained over the entire area at a constant distance from the control electrodes, the control structure and the anode are separated by an annular frame-like member 20 in cooperation with spacing pins 21 which are suitably located at various points over the area of the control structure and anode.

In the embodiment illustrated, the individual parts are fabricated from suitable materials, as for example a suitable glass for the enclosure, including the front and back plates, the frame member and the struts, while the pins may be made of a ceramic material or of glass. A material that has low sputter characteristics, such as aluminum, may be employed for the cathode and a light metal, likewise such as aluminum, may be employed for the acceleration anode. Luminescent materials emitting light in the basic colors of red, green and blue, comprising compounds which also give off light when bombarded by low-energy electrons may be employed [see for example, Proc. IEEE 61 (1973) page 1025]. The respective row and column conductors may be of NiCr, and the structure can be filled with a suitable gas such as He, Ne, $H_2$, $N_2$ or the like, with an internal gas pressure of a few Torr.

In operation of a display such as that described, the individual electrodes would be connected to suitable potentials, for example, the surface cathode to −300V, the pertinent actuated row conductors to ground potential, the unactuated column conductors to −30V, activated column conductors to ground potential and the acceleration anode to 4.5 kV. All nonactuated row lines may assume the potential of their surroundings, i.e. they may "float", exerting no influence on the gas discharged burning in the shape of a wedge between the surface cathode and the lines being actuated.

Further details regarding manufacture and operation may be derived from U.S. Pat. No. 3,956,667, previously referred to, and German Pat. Applications Ser. Nos. P 26 15 721.1, and P 26 15 681. German application P 26 15 681 likewise discloses methods of shaping and spacing the control structure to provide advantages which are applicable in the utilization of a display device in accordance with the present invention.

Figure 2:
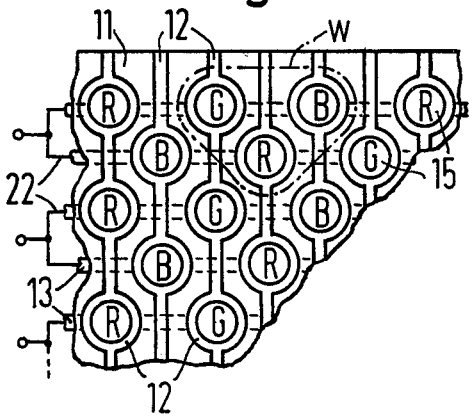
FIG. 2 illustrates a portion of a two-chamber matrix panel having an aperture configuration and color dot distribution corresponding to that of a mask-type picture tube employing a dot configuration, as seen from the observing side of the device.

FIG. 2 represents a portion of a control structure in which the color-dot picture screen of which corresponds as far as possible, to that of the usual colored picture tube employing a dot formation. The apertures in a row are alternately allocated to the basic colors red, green and blue, designated in the figure by the letters R, G, B, with the apertures of every second horizontal row of apertures being slightly offset with the basic colors being suitably allocated thereto in such a manner that for any one spot of a color, those the six nearest thereto are associated with the other two colors which are alternately disposed therearound. In order to produce a white dot, represented in the figure by a broken line and designated by the reference letter W, from a trio of colors, in a manner corresponding to the usual vacuum tube, two adjacent rows of apertures, one above the other, and three columns of apertures all disposed adjacent to one another would have to be simultaneously actuated. Thus each picture line would comprise two rows of apertures, indicated in the figure by the connection of respective pairs of adjoining supply lines 22.

It will be noted that the conductor paths do not extend through the apertures in the sheet, but rather encircle the apertures whereby the passage of current cannot be blocked by disturbing charges. It will be appreciated from the figure that the column conductors must extend between the portions of the two adjacent conductors bordering the particular aperture and that such adjacent conductors must, of necessity, be very small and even then would be very closely disposed. Calculations with respect to possible spark-over indicates that in a TV picture screen of normal format and resolving power with round holes 275 $\mu$ in diameter and technologically feasible column widths of 55 $\mu$, the smallest distances between adjacent conductors also would be 55 $\mu$, a value clearly under the acceptable minimum distance.

Figure 3:
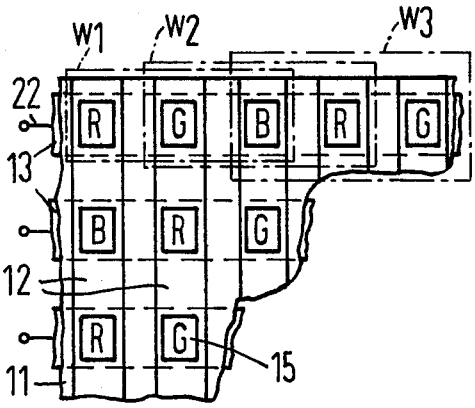
FIG. 3 is a figure, similar to FIG. 2, of one embodiment in accordance with the present invention.

FIG. 3 illustrates the color arrangement in a control structure for a TV picture screen, in accordance with the present invention. In this particular arrangement the no offset apertures are involved and the picture line comprises merely a single row of apertures. In the even-numbered lines, the color allocation is shifted to the right, as viewed in FIG. 3, by one aperture. As will be apparent a shift to the left by one aperture would provide equivalent results. In this arrangement white dots are produced by actuation of merely a single line, i.e. a single row conductor, and three adjacent column conductors, for example white dots $w_1$, $w_2$, $w_3$.

It will be noted that the gaps or spacing between the individual apertures are smaller in the horizontal direction than in the vertical direction and that the apertures of a trio of colors thus form corners of a right-angled scalene triangle, with the smaller of the sides of such triangle extending parallel with the line direction. In the present instance, the apertures have a configuration in the form of upright rectangles, which thus are narrow in the line direction, whereby a sufficiently large column conductor spacing is still assured, and of a suitable height to preserve a large aperture cross-section and, consequently, a high level of maximum brightness. The height of the apertures as well as the width thereof, can be varied within relatively wide limits as the adjacent line conductors are relatively widely separated.

The selected aperture pattern, without offsetting of the apertures, not only results in a low-capacity control structure but also materially simplifies the display design. Where thin-walled front plates are involved, the control structure no longer has to be supported merely by spacing pins, as the design readily facilitates the use of supporting plates which extend between the front and back plates, having portions which pass through the control board between adjacent rectilinear column conductors.

Figure 4:
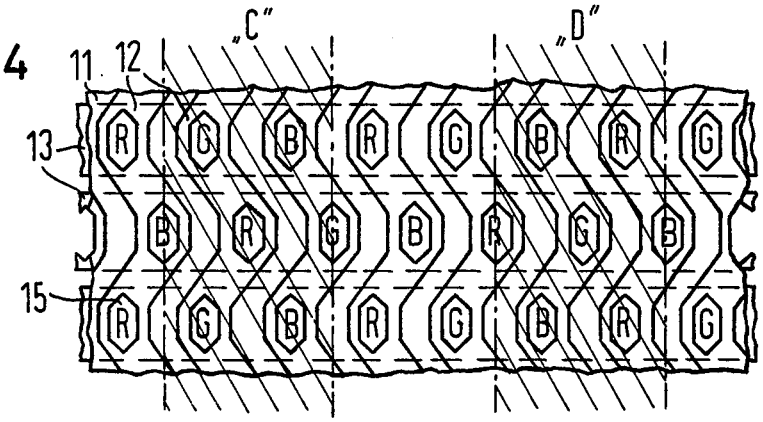
FIG. 4 is a figure, also similar to FIG. 2, illustrating a modified form of control structure.

In the embodiment of control board, in accordance with the invention, illustrated in FIG. 4, the apertures of a picture line are arranged relatively close together and the apertures of the even-numbered lines are offset slightly relative to the apertures of the odd-numbered lines, in the direction in which the color allocation is shifted. This arrangement enables the use of an aperture similar to the usual hexagonal color-dot screen, in which the trios of colors form isosceles triangles with shortened base sides extending parallel with the picture lines. It will be appreciated that in the modification illustrated in FIG. 4 the physiological impression to the observer is somewhat improved over a pattern which does not involve an offset configuration, as a better mixing or blending of the colors is obtained. However, with the employment of a hexagonal aperture pattern, greater difficulty is experienced in extending supporting plates, if required, through the control structure.

The spatial relationships and resolving power values of the embodiment illustrated in FIG. 4 will be illustrated by means of a numerical example. Assuming a picture screen having a format of 53 × 40 $cm^2$ (width × height), comprising 625 picture lines and 1500 apertures per line, each aperture would have a cross-section of 0.075 $mm^2$. If the apertures illustrated in FIG. 4 were given a height of 500 $\mu$ and a width of 200 $\mu$ with a selection of aperture border portions 70 $\mu$ in width, the adjacent line or column conductors come no closer than about 100 $\mu$. With these parameters, a resolving power of 312.5 double lines in the vertical direction and of 375 double lines in the horizontal direction, possibly even more in dependence upon the white dot evaluation (the isosceles triangles of color lying one under another forming vertical lines which are illustrated in the figure by the shaded zones designated by the letters C and D). In comparison with a conventional 625 line mask picture tube with 400,000 apertures and some 546 color trios in the vertical and 728 color trios in the horizontal directions, only 273 double lines can be resolved in the vertical direction and 364 in the horizontal direction. It will be noted, in contrast to the picture tube, that with a display structure in accordance with the invention, the position of the white dot can be shifted horizontally by one color dot at any time, while with the picture tube, the resolution is fixedly determined by the mask holes.

Figure 5:
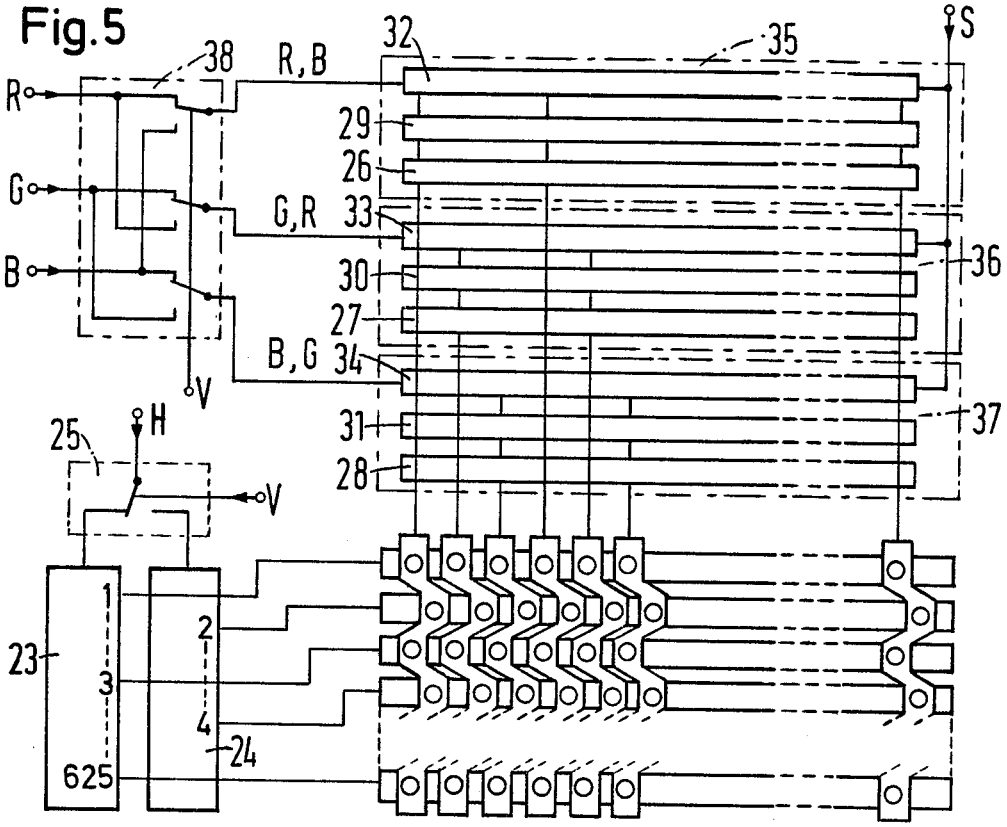
FIG. 5 illustrates, in block form, an actuation circuit for operation of the display illustrated in FIG. 1.

FIG. 5 illustrates, in block form, a diagram of the electronic actuation system, which is in the form of an interlaced scanning system matched to the proposed display arrangement.

The conductors of all odd picture lines are connected with a first unit 23 comprising a counter and a driver with, for example, transistors grounded on the emitter side, while the conductors of all even lines are connected with a second unit 24, both of which units are of analog construction. The inputs of such units are connected with a first half-image switch 25 which receives impulses at the line frequency (horizontal-impulses) and is triggered by the impulses of the image-changing frequency (vertical-impulses). Every third column conductor is connected to a shift register 32, 33, 34 through a corresponding common storage and driver unit 26, 27, 28 and a corresponding common switch 29, 30, 31. The assemblies each formed by a shift register, switch, storage and driver unit are illustrated in FIG. 5 by broken lines and designated by the respective reference numerals 35, 36, 37.

The individual shift registers receive color signals from the outputs of a second half-image switch (cyclical color transposer) 38, which controls the passage of the color components of the video signal.

The counting and driver units 23, 24 can be eliminated if the self-scan principle is utilized for actuation purposes. In this case the odd-numbered lines would have to be conducted out of the picture field on one side and the even-numbered lines on the other with the further connections of each set of lines suitably supplied through a supply column.

In operation of the display device, the odd-numbered lines are actuated during a first half-image period and the even-numbered lines during the second half-image period, one following the other in synchronization with the horizontal pulses, such actuation being effected by raising the potential of the line conductors to ground potential. The gas-discharge, burning between the surface cathode disposed at a potential of about −300V, and the line being actuated, is successively passed on to the next line without going out in the meantime.

When a line is activated, the information for such line, the color components of which have been initially supplied to the shift registers in synchronism with advance pulses S, and recalled during the line black-out pulses by means of the switch triggered by the H-impulses, is simultaneously supplied to all column conductors over the storage and driver units. While a specific line is thus operating (TV standard of 53 $\mu$ sec) the shift registers are already being supplied with information for the next line to be activated.

Since the apertures of a column are alternately allocated to different colors, for example, the first column from the left, as viewed in FIG. 5, employing the colors red and blue, the shift registers must be supplied with one color during one half period and with the other color during the other half period. In the example illustrated, the shift register 32 must receive the red color component during the first half period and the blue color component during the second half period. This operation is achieved by a cyclical color transposer 38 which is connected ahead of the shift registers and triggered by vertical impulses.

When the apertures are of slot-shaped configuration, only a few tens of volts, for example 30V, are required for full actuation of the apertures in the sheet since the electrons, diffusing from the prismatic gas discharge to the apertures, have very little kinetic energy. Consequently, it is possible to construct the shift registers, switches, stores and drivers in the form of integrated circuits (ICs). Even the line counters can be integrated circuits if the self-scan method is not being employed for actuation purposes. The integrated circuits may be constructed utilizing bipolar technology in view of the current requirements for the gas discharge.

Figure 6:
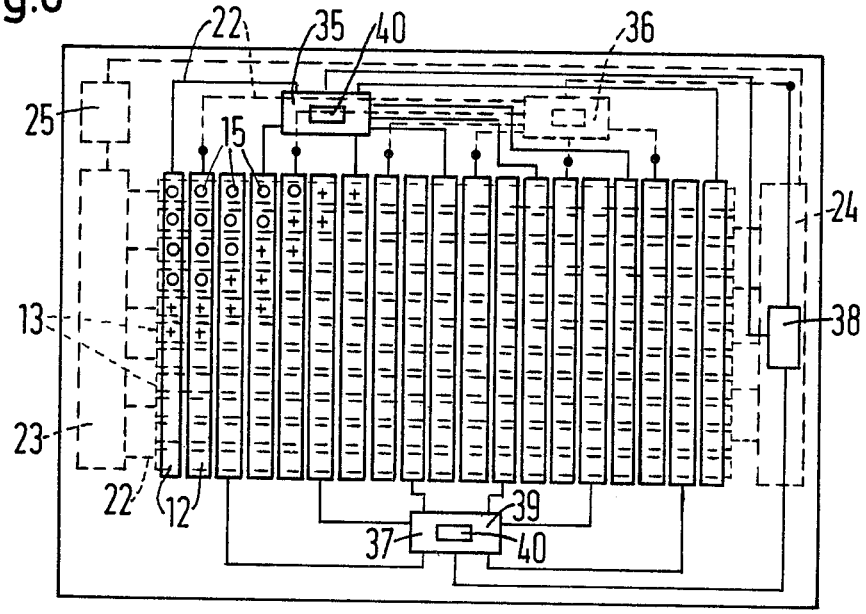
FIG. 6 is a plan view of a control structure suitable for the embodiment illustrated in FIG. 1, likewise as seen from the viewing side of the display device.

FIG. 6 illustrates, in highly diagrammatic manner, the individual actuating components and their distribution on the edges of the control board. The units 23 and 24 (integrated line-counting circuits) are illustrated as located on the edges of the narrow side of the sheet, on the rear face thereof, i.e. the side facing the surface cathode. The integrated shift register circuits (assemblies 35, 36, 37) are placed on the edges of the broad sides of the sheet, with two integrated shift register circuits being disposed on the front face and one on the back face. This arrangement ensures that the supply lines extending, in a diverging or star configuration, from the integrated circuits to the vertical conductor paths do not cross over and cannot create much mutual loading. The supply lines to the integrated shift register circuit 36 are conducted through the sheet in the general vicinity of the column conductors, for example, by means of cooperable pins extending through the sheet. The transposing switch 38, from which a conductor path runs to each of the integrated shift register circuits, is disposed on one of the two edges of the narrow sides of the sheet.

Figure 7:
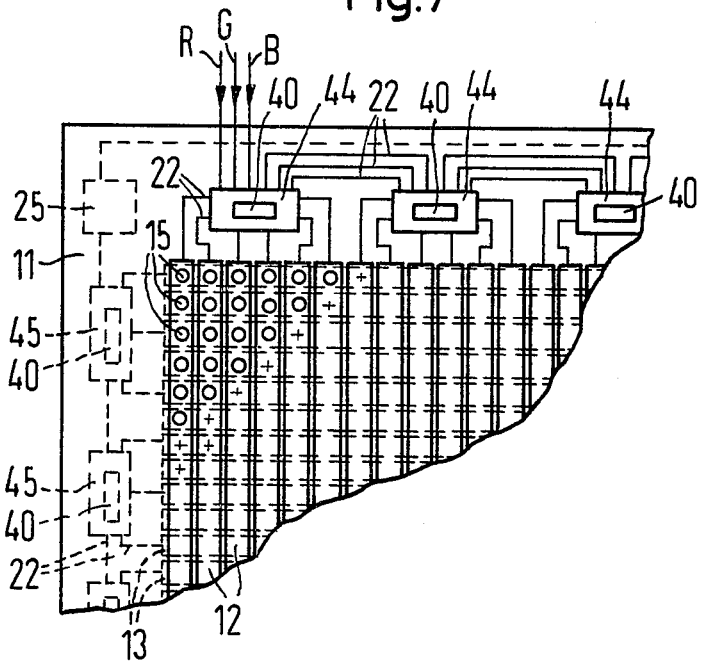
FIG. 7 is a plan view similar to FIG. 6 of a portion of a control structure of modified construction.

If it is desired to provide the sheet with all actuating components in one layer, and thus avoid making connections through the sheet from one face to the other thereof, the component grouping illustrated in FIG. 7 can be employed. In this embodiment, a number of adjacent column conductors are brought out together to a component 44 which includes a shift register, a switch and a storage and drive unit for each one of the three basic colors. The component 44 on the far left of FIG. 7 receives the three color signals which are then passed on from component to component. All of the components 44 are disposed on the front face of the sheet.

The counter and driver units likewise could be separated into spatially independent subunits 45 located on the back of the sheet, which subunits would then have to be connected so that the continuously switching horizontal pulse could be conducted onward.

Division of the signal processing units into subunits with relatively few units and correspondingly few connections is recommended when contact has to be made with a very large number of conductor connections.

Figure 8:
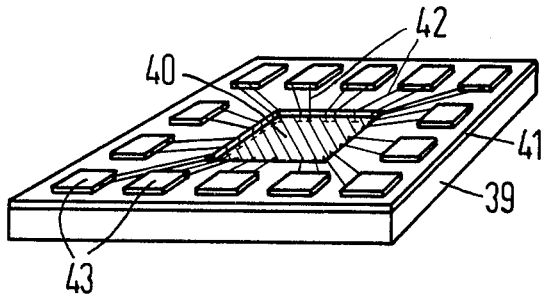
FIG. 8 is a perspective view of an integrated switching circuit, illustrated in block form, in FIGS. 6 and 7.

Hybrid integration is illustrated in FIG. 8 which ensures that the many connections linking the integrated line-counting circuits and integrated shift-register circuits with the line and column conductors can be made in a reliable and economical manner. Each integrated circuit comprises a semiconductor substrate 39 having dimensions of approximately $30 \times 30$ mm$^2$, the active face 40 being provided with the transistors, resistors, etc. and making up merely a small part of the total area of the chip. The remainder of the substrate is coated with an insulating layer 41 which carries the diverging or radiating contact paths 42 and pads 43 that can be soft-soldered. Such pads may be soft-soldered to the conductor supply lines which, following passage through the enclosure wall, expediently are of burned silver or palladiumsilver paste. However, other solderable material may be employed. The chips also can be attached to the edge of the sheet by first attaching the substrate thereto, utilizing a free-flowing glass solder, and then attaching the various conductor path connections from the chip to the surface of the plate.

Having thus described our invention it will be obvious that although various minor modifications might be suggested by those versed in the art, it should be understood that we wish to embody within the scope of the patent granted hereon all such modifications as reasonably, and properly come within the scope of our contribution to the art.

We claim as our invention:

1. A gas discharge display device for multicolored data display in three basic colors, comprising a gas-filled, gastight enclosure, a board-like matrix control structure, dividing the enclosure into two chambers, which is in the form of an insulating plate having a plurality of apertures therethrough, arranged in an array of coordinate lines corresponding in number to a desired number of image points, a plasma electrode disposed in one chamber, and a luminescent screen electrode disposed in the other chamber, the control structure having a plurality of auxiliary anode conductors disposed on the side of said plate facing said plasma electrode, and a plurality of control conductors disposed on the side of said plate facing said luminescent screen electrode, with each of the conductors extending around the edges of the associated apertures, each of the conductors on one side being associated with a row of apertures, and each of the conductors on the other side being associated with a column of apertures, the plasma electrode being so disposed that upon application of appropriate potentials to the respective conductors and plasma electrode a gas discharge can burn in the discharge chamber and the luminescent screen electrode is disposed sufficiently close to the adjacent conductors on the matrix member, than under such conditions even a few kV applied to such screen electrode cannot trigger any undesired gas discharge, the auxiliary anode conductors each containing a corresponding line of apertures with each three successive apertures being allotted to the three basic colors, and each third aperture being allotted to the same basic color, each control conductor interconnecting each successive aperture along the line in which such conductor extends, with each two successive apertures being allotted to two of the three basic colors and each second aperture being allotted to the same basic color, the color allocation for even-numbered auxiliary anodes is shifted relative to the odd-numbered auxiliary anodes by one aperture in the direction in which the auxiliary anodes extend.

2. A gas-discharge display device according to claim 1 having row and column conductors, wherein the auxiliary anodes are formed by the row conductors and the control electrodes are formed by the column conductors.

3. A gas-discharge display device according to claim 2, wherein the apertures of the even-numbered auxiliary anodes are additionally offset in the direction in which the color allocation is shifted by an amount roughly corresponding to half the distance between successive apertures of one auxiliary anode.

4. A gas-discharge display device according to claim 1, wherein the distance between the centers of adjacent apertures of an auxiliary anode is less than the distance between the centers of the closest apertures of neighboring auxiliary anodes.

5. A gas-discharge display device according to claim 3, wherein the distance between the centers of adjacent apertures of an auxiliary anode is less than the distance between the centers of the closest apertures of neighboring auxiliary anodes.

6. A gas-discharge display device according to claim 1, wherein the apertures have an elongated configuration.

7. A gas-discharge display device according to claim 4, wherein the apertures have an elongated configuration.

8. A gas-discharge display device according to claim 6, wherein the narrow sides of the elongated apertures extend generally parallel to the auxiliary anodes extend.

9. A gas-discharge display device according to claim 1, wherein the ends of the conductor paths extend through the enclosure wall and are attached to an edge structure surrounding the enclosure, such edge structure carrying the components required for matrixaddressing, the conductor ends and the adjacent enclosure structure being enclosed in a synthetic resin casing.

10. A gas-discharge display device according to claim 9, wherein all of the actuating components are constructed as integrated circuits, preferably using bipolar technology.

11. A gas-discharge display device according to claim 1, wherein all of the actuating components are constructed as integrated circuits, preferably using bipolar technology.

12. A gas-discharge display device according to claim 1, wherein the actuating components are constructed as integrated circuits and are each disposed on a semiconductor substrate which on its face not carrying the integrated circuit is covered with an insulating coating and which coating is disposed soft-solderable pads which form contacts for operative connecting of the integrated circuit thereto and contacts for operative connection of external circuitry to the integrated circuit.

13. A gas-discharge display device according to claim 9, wherein the actuating components are constructed as integrated circuits and are each disposed on a semiconductor substrate which on its face not carrying the integrated circuit is covered with an insulating coating and which coating is disposed soft-solderable pads which form contacts for operative connecting of the integrated circuit thereto and contacts for operative connection of external circuitry to the integrated circuit.

14. A gas discharge display device according to claim 1, wherein the plasma electrode extends parallel with the matrix plate.

15. A method of operating a gas discharge display device for multicolored data display in three basic colors, comprising a gasfilled, gas-tight enclosure, a board-like matrix control structure dividing the housing into a discharge and a re-acceleration chamber, and comprising an insulating plate having a plurality of apertures therethrough, arranged in an array of coordinate lines corresponding in number to a desired number of image points, a plasma electrode disposed in one chamber and extending parallel with said matrix plate, and a luminescent screen electrode disposed in the other chamber, the control structure having a plurality of anode conductors disposed on the side of said plate facing said plasma elctrode, and a plurality of control conductors disposed on the side of said plate facing said luminescent screen electrode, each of the conductors extending around the edges of the associated apertures, each of the conductors in the discharge chamber being associated with a row of apertures, and each of the conductors in the re-acceleration chamber being associated with a column of apertures, the plasma electrode being so disposed that upon application of appropriate potentials to the respective conductors and plasma electrode a gas discharge can burn in the discharge chamber and the luminescent screen electrode is disposed sufficiently close to the adjacent conductors on the matrix member, under such conditions even a few kV applied to such screen electrode cannot trigger any undesired gas discharge in the re-acceleration chamber, the combination of the anode conductors each containing a corresponding line of apertures with each three successive apertures being alloted to the three basic colors, and each third aperture being alloted to the same basic color, with each control conductor interconnecting each successive aperture along the line in which such conductor extends and two different basic colors being alloted alternately to the apertures of each column conductor, the corresponding conductors of each successive three conductors being alloted to a different pair of basic colors, comprising the steps of activating odd-number anode conductors in succession during a first half-period, and the even-numbered anode conductors during a second half-period in accordance with the interlace technique.

16. A method according to claim 15, comprising in further combination, the steps of controlling the alternate activation of odd-numbered and even-numbered anode conductors by the video vertical synch pulses, independently storing the respective color component information of a video picture line, supplying each such color component to a respective one of each successive three column conductors during a half-period, in correspondence to the color associated with such conductors and the activated odd-numbered anode conductors, and during the next half-period, supplying to each such column conductors the color component associated with it and the activated even-numbered anode conductors.

17. A gas discharge display device for multicolored date display in three basic colors, comprising a gas-filled, gas-tight enclosure, a board-like matrix control structure, dividing the enclosure into two chambers, which is in the form of an insulating plate having a plurality of apertures therethrough, arranged in an array of coordinate lines corresponding in number to a desired number of image points, a plasma electrode disposed in one chamber, and a luminescent screen electrode disposed in the other chamber, the control structure having a plurality of anode conductors disposed on the side of said plate facing said plasma electrode, and a plurality of control conductors disposed on the side of said plate facing said luminescent screen electrode, with each of the conductors extending around the edges of the associated apertures, each of the conductors on one side being associated with a row of apertures, each each of the conductors on the other side being associated with a column of apertures, the plasma electrode being so disposed that upon application of appropriate potentials to the respective conductors and plasma electrode a gas discharge can burn in the discharge chamber and the luminescent screen electrode is disposed sufficiently close to the adjacent conductors on the matrix member, than under such conditions even a few kV applied to such screen electrode cannot trigger any undesired gas discharge, the anode conductors each containing a corresponding line of apertures with each three successive apertures being allotted to the three basic colors, and each third aperture being allotted to the same basic color, each control conductor interconnecting each successive aperture long the line in which such conductor extends, the ends of the conductor paths extending through the enclosure wall and attached to an edge structure surrounding the enclosure, such edge structure carrying the components required for matrixaddressing, the conductor ends and the adjacent enclosure structure being enclosed in a synthetic resin casing, and an assembly for each of the three basic colors, each assembly comprising a shift register, a switch and a storage and driver unit, which assemblies are each connected to every respective third control electrode and are located on the two edge faces running at right angles to the direction in which the control electrodes extend, one assembly being disposed on the face of one edge facing the acceleration anode, another assembly being disposed on the back face of the same edge and the third assembly being disposed on the front face of the other edge, off-numbered auxiliary anodes being connected to a first counter and driver unit and even-numbered auxiliary anodes being connected to a second counter and driver unit, which units are located on the back face of the edge running parallel with the control electrodes.

18. A gas discharge display device according to claim 17, wherein all of the actuating components are constructed as integrated circuits, preferably using bipolar technology.

19. A gas discharge device for multicolored data display in three basic colors, comprising a gas-filled, gas-tight enclosure, a board-like matrix control structure, dividing the enclosure into two chambers, which is in the form of an insulating plate having a plurality of apertures therethrough, arranged in an array of coordinate lines corresponding in number to a desired number of image points, a plasma electrode disposed in one chamber, and a luminescent screen electrode disposed in the other chamber, the control structure having a plurality of anode conductors disposed on the side of said plate facing said plasma electrode, and a plurality of control conductors disposed on the side of said plate facing said luminescent screen electrode, with each of the conductors extending around the edges of the associated apertures, each of the conductors on one side being associated with a row of apertures, and each of the conductors on the other side being associated with a column of apertures, the plasma electrode being so disposed that upon application of appropriate potentials to the respective conductors and plasma electrode a gas discharge can burn in the discharge chamber and the luminescent screen electrode is disposed sufficiently close to the adjacent conductors on the matrix member, than under such conditions even a few kV applied to such screen electrode cannot trigger any undesired gas discharge, the anode conductors each containing a corresponding line of apertures with each three successive apertures being allotted to the three basic colors, and each third aperture being allotted to the same basic color, each control conductor interconnecting each successive aperture long the line in which such conductor extends, the ends of the conductor paths extending through the enclosure wall and attached to an edge structure surrounding the enclosure, such edge structure carrying the components required for matrix-addressing, the conductor ends and the adjacent enclosure structure being enclosed in a synthetic resin casing, a number of neighboring control electrodes in each case being connected to a component which comprises a shift register, a switch, and a storage and driver unit, for each of the three basic colors, in which the components are interconnected and located on the face of one edge facing the acceleration anode, with a plurality of odd-numbered neighboring auxiliary anodes and a plurality of even-numbered neighboring auxiliary anodes being connected to a counter and driver sub-unit, the sub-units for the odd-numbered auxiliary anodes and the sub-units for the even-numbered auxiliary anodes each being interconnected and all being located on the back face of the edges running parallel with the control electrodes.

20. A gas discharge display device for multicolored data display in three basic colors, comprising a gas-filled, gas-tight enclosure, a board-like matrix control structure, dividing the enclosure into two chambers, which is in the form of an insulating plate having a plurality of apertures therethrough, arranged in an array of coordinate lines corresponding in number to a desired number of image points, a plasma electrode disposed in one chamber, and a luminescent screen electrode disposed in the other chamber, the control structure having a plurality of anode conductors disposed on the side of said plate facing said plasma electrode, and a plurality of control conductors disposed on the side of said plate facing said luminescent screen electrode, with each of the conductors extending around the edges of the associated apertures, each of the conductors on one side being associated with a row of apertures, and each of the conductors on the other side being associated with a column of apertures, the plasma electrode being so disposed that upon application of appropriate potentials to the respective conductors and plasma electrode a gas discharge can burn in the discharge chamber and the luminescent screen electrode is disposed sufficiently close to the adjacent conductors on the matrix member, than under such conditions even a few kV applied to such screen electrode cannot trigger any undesired gas discharge, the anode conductors each containing a corresponding line of apertures with each three successive apertures being allotted to the three basic colors, and each third aperture being allotted to the same basic color, each control conductor interconnecting each successive aperture long the line in which such conductor extends, a first counter and driver unit connected to all odd-numbered anode conductors for operatively activating such conductors in succession during a first half-period, and a second counter and driver unit for operatively actuating all even-numbered anode conductors in succession, and switching means for selectively alternately actuating said counters in response to vertical synch pulses of a video signal, a control means for each color component each such means comprising a shift register and a storage device, with each such means being operatively connected to a respective one of each three successive column conductors, for supplying thereto such color components in proper color sequence, and means for selectively connecting the respective color components to the shift register in dependence upon the color allotted to such column conductors and the cooperable anode conductor.

* * * * *